US005927692A

United States Patent [19]

Huggett et al.

[11] Patent Number: 5,927,692

[45] Date of Patent: Jul. 27, 1999

[54] WINCH WITH EPICYCLIC FINAL REDUCTION GEAR DRIVE

[75] Inventors: Richard David John Huggett, Hillbrow; David Roberts, Nr Southampton, both of United Kingdom

[73] Assignee: Lewmar Marine Limited, Havant, United Kingdom

[21] Appl. No.: 08/958,005

[22] Filed: Oct. 27, 1997

[30] Foreign Application Priority Data

Nov. 18, 1996 [GB] United Kingdom ..... 9623948

[51] Int. Cl.[6] ..... B66D 1/22

[52] U.S. Cl. ..... 254/344; 254/342

[58] Field of Search ..... 254/342, 344; 475/297, 296, 294, 338, 901, 902

[56] References Cited

U.S. PATENT DOCUMENTS

| | | | |
|---|---|---|---|
| 2,402,756 | 6/1946 | Lawler | 254/344 |
| 2,891,767 | 6/1959 | Armington | 254/344 |
| 3,176,545 | 4/1965 | Schwerdhofer | 475/294 |
| 3,599,937 | 8/1971 | Carter | 254/150 |
| 3,627,087 | 12/1971 | Eskridge | 192/8 |
| 3,656,596 | 4/1972 | Morgan | 192/17 R |
| 3,712,155 | 1/1973 | Stommel et al. | 74/810 |
| 3,803,947 | 4/1974 | Hillyer | 74/750 B |
| 3,813,185 | 5/1974 | Bouiller et al. | 416/198 |
| 3,927,580 | 12/1975 | Fawcett | 74/812 |
| 3,962,935 | 6/1976 | Hutton et al. | 74/812 |
| 4,118,013 | 10/1978 | Christison et al. | 254/187.5 |
| 4,191,510 | 3/1980 | Teysseyre et al. | 416/230 |

FOREIGN PATENT DOCUMENTS

| | | | |
|---|---|---|---|
| 722997 | 2/1955 | United Kingdom | 475/297 |
| 2001596 | 2/1979 | United Kingdom | 254/342 |
| 2249364 | 5/1992 | United Kingdom | 475/296 |

*Primary Examiner*—Donald P. Walsh
*Assistant Examiner*—Minh-Chau Pham
*Attorney, Agent, or Firm*—St. Onge Steward Johnston & Reens LLC

[57] ABSTRACT

A winch has a final epicyclic reduction drive to its drum. The planetary gearing of the drive is borne in a web of the drum. Input to the final drive is via a ring driven either directly from a drive shaft or via reduction drive trains spaced axially from the final drive in the base of the drum. The drum may be of carbon-fibre material.

10 Claims, 1 Drawing Sheet

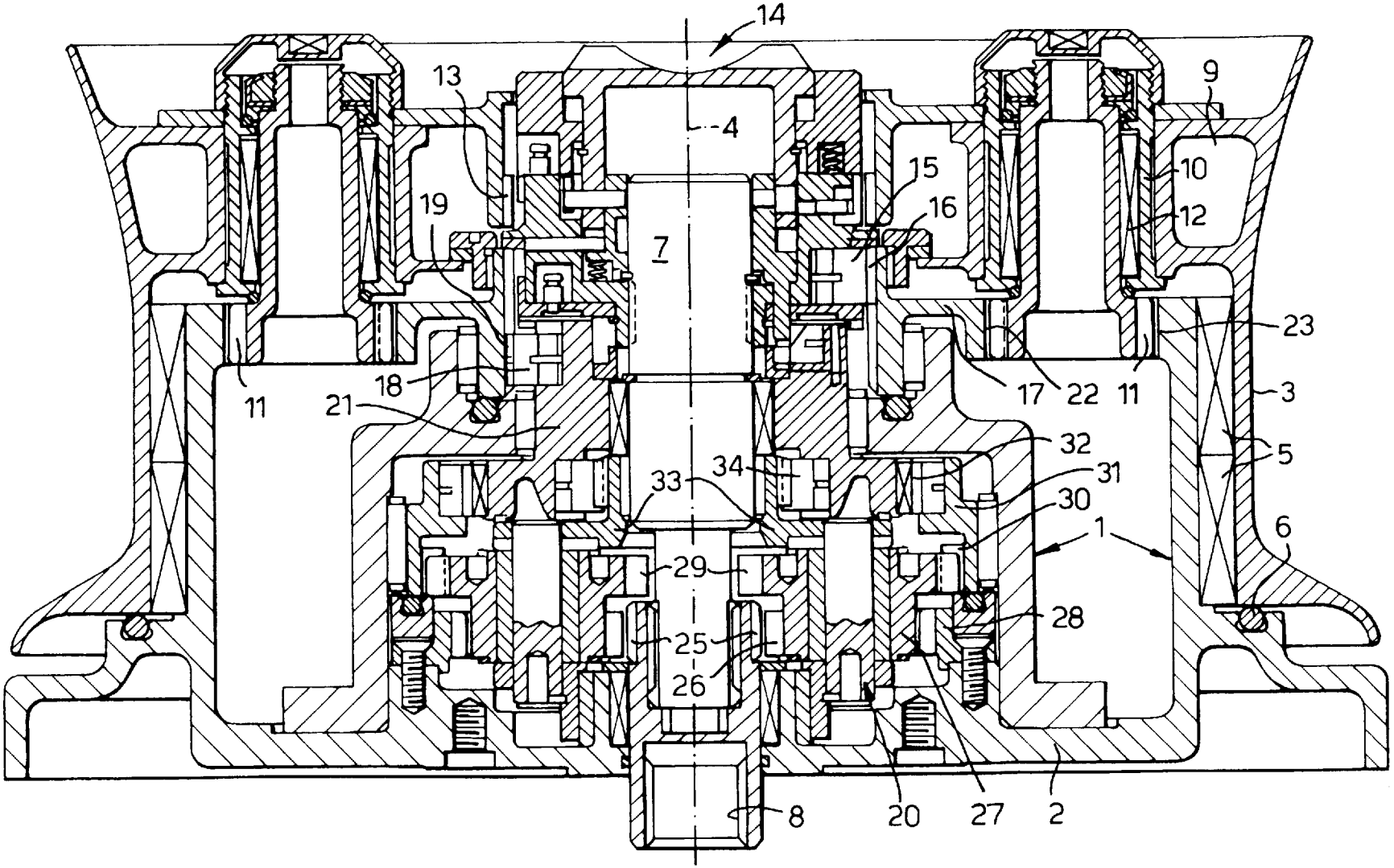
1
2
3
4
5
6
7
8
9
10
11
12
13
14
15
16
17
18
19
20
21
22
23
25
26
27
28
29
30
31
32
33
34

WINCH WITH EPICYCLIC FINAL REDUCTION GEAR DRIVE

FIELD OF THE INVENTION

This invention relates to winches which have an epicyclic gear drive. The winches are for yachts and other water-borne vessels.

BACKGROUND OF THE INVENTION

Epicyclic gears have been used in winches before—see for example U.S. Pat. No. 3,682,442 and GB-A-2253199 and GB-A-1353607.

GB-A-2253199 is concerned with the provision of multiple gear trains capable of giving extremely high reductions, provided in a detachable gearbox mounted at the head of the winch.

U.S. Pat. No. 3,682,442 provides an epicyclic gear in which the axes of rotation of planet gears are borne on a rotatable carrier which intervenes between the central drive shaft and the winch drum which is to be driven. Oppositely-directed sprag clutches between the drive shaft and the carrier enable either 1:1 direct drive to be transmitted through the locked-up planetary gearing (the carrier being effectively locked stationary by the sprag clutches in one direction of rotation of the shaft) or with a moderate reduction, 1:4 being mentioned, through mutual relative rotation of all of the shaft, the carrier and the drum.

GB-A-1353607 has a final output epicyclic of which the planetary gear is borne in part of the drum as its carrier. Reversible drive is applied via an input epicyclic either to the output epicyclic in one direction of drive or directly to the drum in the other direction with the planetary gear of the final drive being ineffective.

SUMMARY OF THE INVENTION

The present invention is concerned with the provision of an epicyclic gear as a reduction drive to the drum of a winch from each of a plurality of drive trains which are engaged respectively upon different directions of rotation of a main drive shaft. This is achieved by making the planetary gear or set of planetary gears (hereinafter "planetary gearing") of the final epicyclic to be carried by a part of the winch which at all times is constrained to rotate with the drum of the winch about the axis of rotation of the latter. That part may be part of the drum itself. The input to the final epicyclic may be a direct drive from a main drive shaft of the winch or one which has already been reduced in relation to the rotation of the main shaft by one or more drive trains of respectively different ratios, and one or more of these drive trains may be epicyclic in character. When such prior reduction drive trains are provided they will normally be axially spaced from the final epicyclic, with output drive from them being transferred to the input of the final epicyclic by an axially-extending transfer member.

The final epicyclic planetary gearing may be carried by a web of the winch drum such that drive to the drum is transmitted solely through that web. This enables the drum to be devoid of any internal final gear ring for driving that drum which means that one of the prime difficulties lying in the way of the provision of carbon-fibre reinforced drums is avoided (such drums have been proposed in the past but there have been serious problems in adequate securing of an internal final drive gearing to those drums).

DESCRIPTION OF THE DRAWING AND OF A PREFERRED EMBODIMENT

A particular embodiment of the invention is now described with reference to the accompanying drawing which is a section on two radii.

The winch has a frame 1 to be secured by a base 2 to a deck of a vessel. A drum 3 may be formed of any suitable material, but the final drive arrangement to be described allows the use of a carbon-fibre reinforced material. It is borne for rotation about a central axis 4 of the winch on bearings 5,6 on the frame.

Centrally of the winch there is a main drive shaft 7 which is splined at its base to drive input shaft 8 which has an input socket for receiving drive from below the winch.

The drum 3 has a top web 9 in which are set bushings 10 for planetary output gearing 11, borne in the bushings by bearings 12.

The web 9 is a box girder structure over most of the top surface of the drum for the better transmission of drive from the planetary final output gearing 11 via the bushing 10 and bearings 12 to the drum and for maintenance of the axes of rotation the gearing 11 parallel to the axis 4.

At the head of the shaft 7 there is provided a control mechanism 14 to allow selection of the various drives to be engaged upon successive rotations of the drive shaft 7. This mechanism is fully described in our UK Patent Application No 9623949.6 filed Nov. 18, 1996. Another suitable control mechanism is fully described in U.S. Pat. No. 3,973,755 (GB-A-1486777), the content of which is incorporated by reference. The nature of the control mechanism is not important to the present invention; indeed the invention is applicable to two-speed winches, which do not require complex, or sometimes any, selector controls.

In the present embodiment pawls (not shown) are provided in the head of the control mechanism engageable with a ratchet track 13 on the web of the drum, to give a 1:1 drive to the drum. The mode of control of these pawls is per se known from U.S. Pat. No. 3,973,755.

To achieve reduction drives in the present embodiment, drive arrives at a drive ring 17, dependent upon the direction of rotation of the drive shaft 7 and upon the setting of the control 14, either via pawls 15 which project to engage with ratchet track 16, to rotate the drive ring 17 in a 1:1 ratio from the drive shaft 7, or via pawls 18 and ratchet track 19 on the ring 17 from a transfer member from reduction gear trains in the lower part of the winch. These gear trains may be of conventional gearing or may be, as indicated here at 20, epicyclic gearing driving an intermediate transfer sleeve 21 at various reductions relative to the shaft 7, as is fully described in our copending patent application Ser. No. 08/934,997 filed Sep. 22, 1997 and claiming priority of UK Patent Application No 9620313.8.

Drive of the drum 3 is achieved by the rolling action of the planetary gearing 11 about its own axis between a gear ring 22 on the ring 17 and a stationary gear ring 23 at the head of the frame 1, while orbiting around the central axis 4: that is, in each case the final epicyclic itself acts as a reduction between the ring 17 and the drum 3.

Drive to the lower gear trains is from gear teeth 25 on input shaft 8 via an idler gear (not shown) to teeth 26 of a double planetary gearing 27 which engage also a stationary gear ring 28. The other teeth 29 of the double planetary gearing engage a gear ring 30 on a first part 31 of the transfer member which comprises also the transfer sleeve 21. Rotatably borne inside the frame 1 the first part engages the transfer sleeve 21 through pawl and ratchet unidirectional drive 32.

A flanged sleeve 33 is the carrier for the planetary gearing 27 and can drive the transfer sleeve 21 through pawl and ratchet unidirectional drive 34.

The arrangement of unidirectional drives 34 and 32 ensures that drive is transmitted from the shaft 8 to the input drive ring 17 at two different ratios according to the direction of rotation of the shaft 7; in one direction the orbiting rotation of the gearing 27 drives via the flanged sleeve 33 onto the transfer sleeve 21; in the other, rotation of the first part 31 due to the difference in radius of the gear teeth 26,29 drives the transfer sleeve (but in the same direction as the carrier previously).

Since all the drives from the gear trains at the base of the winch are not conventionally communicated to the drum but rather to the intermediate drive ring 17 via the transfer sleeve 21, the diameters and hence the mass of the gears of these trains is much lessened, cutting down on the inertia and frictional effects which can be experienced in winches due to that mass.

In summary, although we have shown here a four-speed winch (1:1; input via pawls 15,16 to ring 17; inputs from both gear trains 20 to ring 17) in which successive drive reductions giving successively increasing mechanical advantages are, subject to the control mechanism 14, passed from the drive shaft to the drum upon successive reversals of direction of rotation of the drive shaft, the invention is applicable to three- or even two-speed winches in which ratios are communicated to the drum by virtue of being the input to a final epicyclic gearing and in each of which the final gearing acts as a reduction drive train.

We claim:

1. A winch having a drum, an axis of rotation of the drum, a drive shaft, an axis of rotation of the drive shaft, a plurality of drive trains, the drive trains being successively engaged between the drive shaft and the drum upon successive reversals of direction of rotation of the drive shaft to drive the drum in one direction of rotation about its axis at successively different drive ratios, each said drive train including a final reduction gear driving the drum, said final reduction gear being an epicyclic with planetary gearing rotatable about an axis of rotation, the axis of rotation of the planetary gearing of the epicyclic being at all times constrained to orbit with the drum as it rotates about its axis.

2. A winch according to claim 1 wherein a carrier of the planetary gearing is a web of the drum.

3. A winch according to claim 1 or claim 2 wherein the drum is of carbon fibre material.

4. A winch according to claim 1 wherein at least two of the plurality of drive trains input to the epicyclic drive are reduction drive trains.

5. A winch according to claim 4 wherein the reduction drive trains are axially spaced from the epicyclic final drive, and an axially extending rotatable member conveys rotational drive from the trains to the epicyclic final drive.

6. A winch according to claim 5 wherein the reduction drive trains are epicyclic.

7. A winch according to claim 1 having additionally a 1:1 drive from the drive shaft to the drum.

8. A winch having an epicyclic final reduction drive to a rotatable drum of the winch, an input to the epicyclic final drive, planetary gearing of the epicyclic final drive being carried by the drum in rotation, a reversibly rotatable drive shaft, a plurality of drive trains of different drive ratio between the drive shaft and the said input, the said different ratios being engageable upon rotation of the drive shaft in respectively different directions to drive the drum in one direction.

9. A winch according to claim 8 wherein the plurality of drive trains include two geared reduction drive trains, said geared reduction drive trains being spaced axially from the said input, and an axially extending rotatable member for conveying rotational drive from the geared reduction drive trains to said input.

10. A winch according to claim 9 wherein the two reduction drive trains are epicyclic.

* * * * *